US008348554B2

(12) United States Patent
Kahr

(10) Patent No.: US 8,348,554 B2
(45) Date of Patent: Jan. 8, 2013

(54) DOCK STRUCTURE, DOCK ASSEMBLY AND METHOD OF CONSTRUCTING THE DOCK STRUCTURE AND ASSEMBLY

(76) Inventor: Michael M. Kahr, Ellison Bay, WI (US)

( * ) Notice: Subject to any disclaimer, the term of this patent is extended or adjusted under 35 U.S.C. 154(b) by 254 days.

(21) Appl. No.: 12/891,065

(22) Filed: Sep. 27, 2010

(65) Prior Publication Data

US 2011/0008110 A1 Jan. 13, 2011

Related U.S. Application Data

(60) Provisional application No. 61/351,444, filed on Jun. 4, 2010.

(51) Int. Cl.
*E02B 3/20* (2006.01)

(52) U.S. Cl. ..... 405/218; 405/221; 405/222

(58) Field of Classification Search ..... 405/218, 405/219, 220, 221, 222
See application file for complete search history.

(56) References Cited

U.S. PATENT DOCUMENTS

| | | | | | |
|---|---|---|---|---|---|
| 2,775,869 | A * | 1/1957 | Pointer | 405/199 |
| 3,158,003 | A * | 11/1964 | Dally | 405/218 |
| 3,345,825 | A * | 10/1967 | Parker | 405/218 |
| 3,964,221 | A * | 6/1976 | Berquist | 405/218 |
| 4,003,209 | A * | 1/1977 | Jackson et al. | 405/218 |
| 4,124,986 | A | 11/1978 | Postma | |
| 4,365,914 | A * | 12/1982 | Sluys | 405/219 |
| 4,709,647 | A * | 12/1987 | Rytand | 405/219 |
| 4,804,298 | A | 2/1989 | Nasby, Jr. | |
| 4,869,620 | A | 9/1989 | Dow | |
| 4,890,959 | A * | 1/1990 | Robishaw et al. | 405/218 |
| 4,948,300 | A * | 8/1990 | Bateson | 405/220 |
| 5,046,897 | A * | 9/1991 | Ray | 405/221 |
| 5,713,296 | A | 2/1998 | Gervasi et al. | |
| 5,788,416 | A * | 8/1998 | Wolgamot | 405/218 |
| 6,179,525 | B1 * | 1/2001 | Gruhn et al. | 405/218 |
| 6,230,644 | B1 * | 5/2001 | Passen et al. | 405/219 |
| 6,648,554 | B1 * | 11/2003 | Sehl | 405/219 |
| 6,994,048 | B1 * | 2/2006 | Jennings | 405/219 |
| 7,033,107 | B2 | 4/2006 | DelZotto | |
| 7,419,329 | B1 * | 9/2008 | Tafoya | 405/218 |

* cited by examiner

*Primary Examiner* — Frederick L Lagman
(74) *Attorney, Agent, or Firm* — Joseph S. Heino; Patrick M. Bergin

(57) ABSTRACT

A dock structure, dock assembly and dock constructing method use one or more dock elements that are attachable to vertical pilings. Each dock element is a pan-like structure having a first end and a second end, a opposing side walls and opposing end walls, with one end wall disposed at each end of the element, and a floor. The side walls, the end walls and the floor form a pan-like cavity. Two cylindrical rims are disposed at the first end of the dock element, each rim forming a vertically-disposed cylindrical opening in the floor of the element and each opening being functionally adapted to receive a piling through it. Each dock element is attachable to pilings and a pair of overlapping members formed at the second end of each dock element allows adjacent elements to be attached one to another. Following attachment, each dock element is filled with concrete.

12 Claims, 3 Drawing Sheets

DOCK STRUCTURE, DOCK ASSEMBLY AND METHOD OF CONSTRUCTING THE DOCK STRUCTURE AND ASSEMBLY

This application claims the benefit and priority of U.S. Provisional Patent Application No. 61/351,444 filed Jun. 4, 2010.

FIELD OF THE INVENTION

This invention relates generally to docks and dock structures used in the marine industry. It also relates to dock assemblies and methods of manufacturing and constructing such assemblies. More specifically, it relates to a dock structure that has enhanced integrity against the elements, and against the freeze-thaw cycles experienced in northern climates.

BACKGROUND OF THE INVENTION

Docks for mooring boats along a shoreline are well known in the art. There are many types of permanent and temporary structures known in the art that allow such mooring and other water activities to take place, such docks allowing persons to have access to deeper parts of the body of water away from shore.

In the experience of this inventor, there is a need for a permanent dock structure that is highly resistant to the freeze-thaw cycles that are experienced in bodies of water that are located in the northern climates. Such a dock structure would also be a height-adjustable structure that would allow the dock to be raised or lowered, subject to water levels that may change from time to time. Such a dock structure would also be configured of dock elements that may be placed into position and which create a form into which concrete may be poured to strengthen the element. Each such dock element is like-configured for uniformity and ease of construction.

SUMMARY OF THE INVENTION

The dock structure and dock assembly of the present invention has obtained these objects. It provides for a plurality of vertical pilings that are spaced apart to accommodate like-configured dock elements between them. Pilings are positioned near the side of a dock element and at each end of a dock element. Lateral elements are placed transversely between each pair of pilings relative to the longitudinal positioning and placement of the dock elements. Each dock element comprises a pan-like structure having internal reinforcement members and a pair of cylindrical openings disposed vertically at one end of the dock element. At the opposite end of the dock element is a hinge means for securing the dock elements in longitudinal and sequential position, and for virtually any length desired or required for a particular application. The foregoing and other features of the present invention will be apparent from the detailed description that follows.

DETAILED DESCRIPTION

Figure 1:
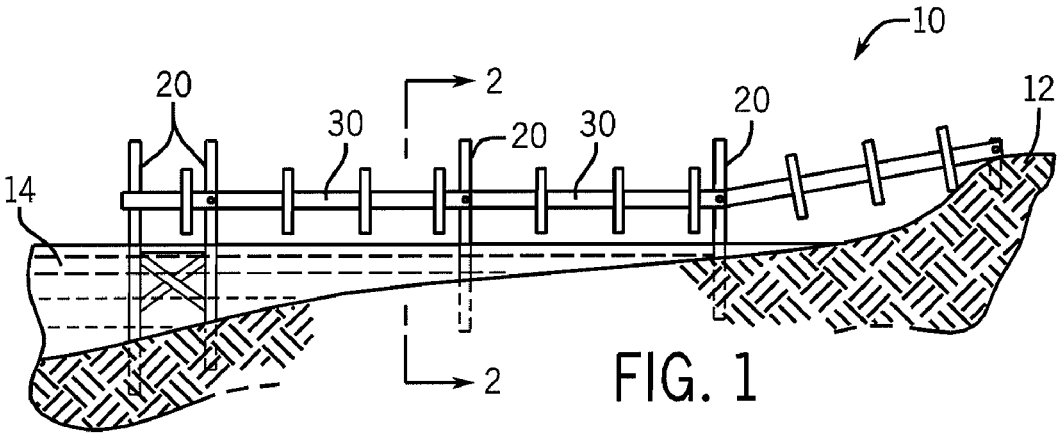
FIG. 1 is side elevational view of a dock assembly constructed in accordance with the present invention and showing the assembly in its installed position.
Figure 2:
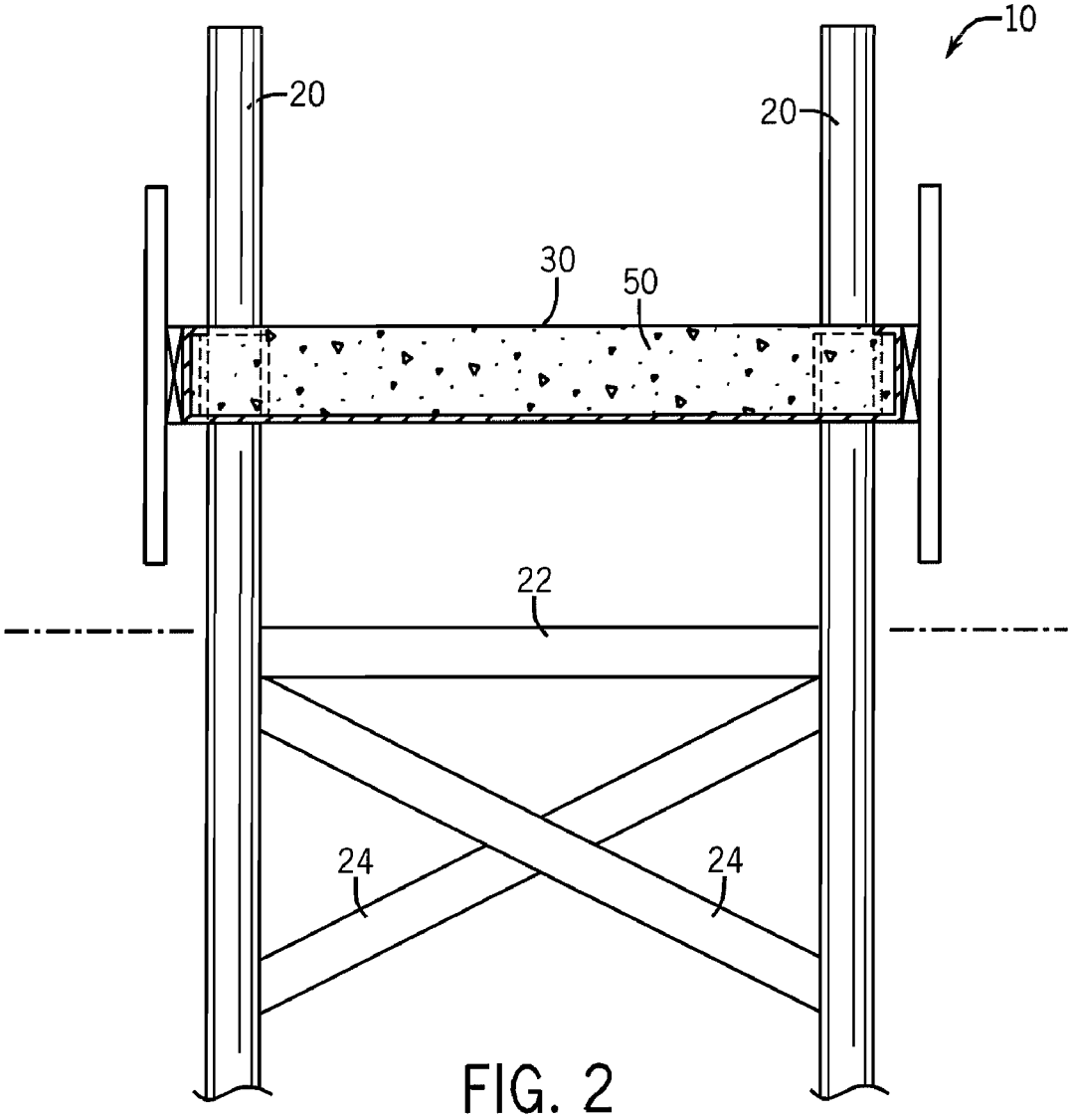
FIG. 2 is a front and cross-sectioned view of the dock assembly shown in FIG. 1 and taken along line 2-2 of FIG. 1.

Referring now to the drawings in detail wherein like numbers represent like elements throughout, FIG. 1 illustrates a side view of the dock assembly, generally identified 10, as it would be constructed in accordance with the present invention. The assembly 10 is comprised of a plurality of pilings 20 and a plurality of dock elements 30 extending from a shoreline 12 and out into a body of water 14. As shown in FIG. 2, transversely adjacent pilings 20 can have horizontal cross members 22 for support and/or a plurality of angled cross members 24. Longitudinally-adjacent dock elements 30 are secured to one another and to pilings 20 using a suitable fastener 60. See FIG. 6.

Figure 4:
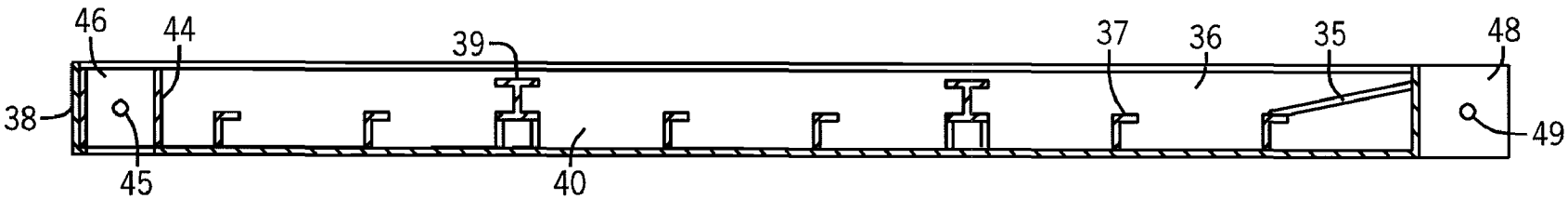
FIG. 4 is a right side elevational and cross-sectioned view of the dock element shown in FIG. 3 and taken along line 4-4 of FIG. 3.
Figure 5:
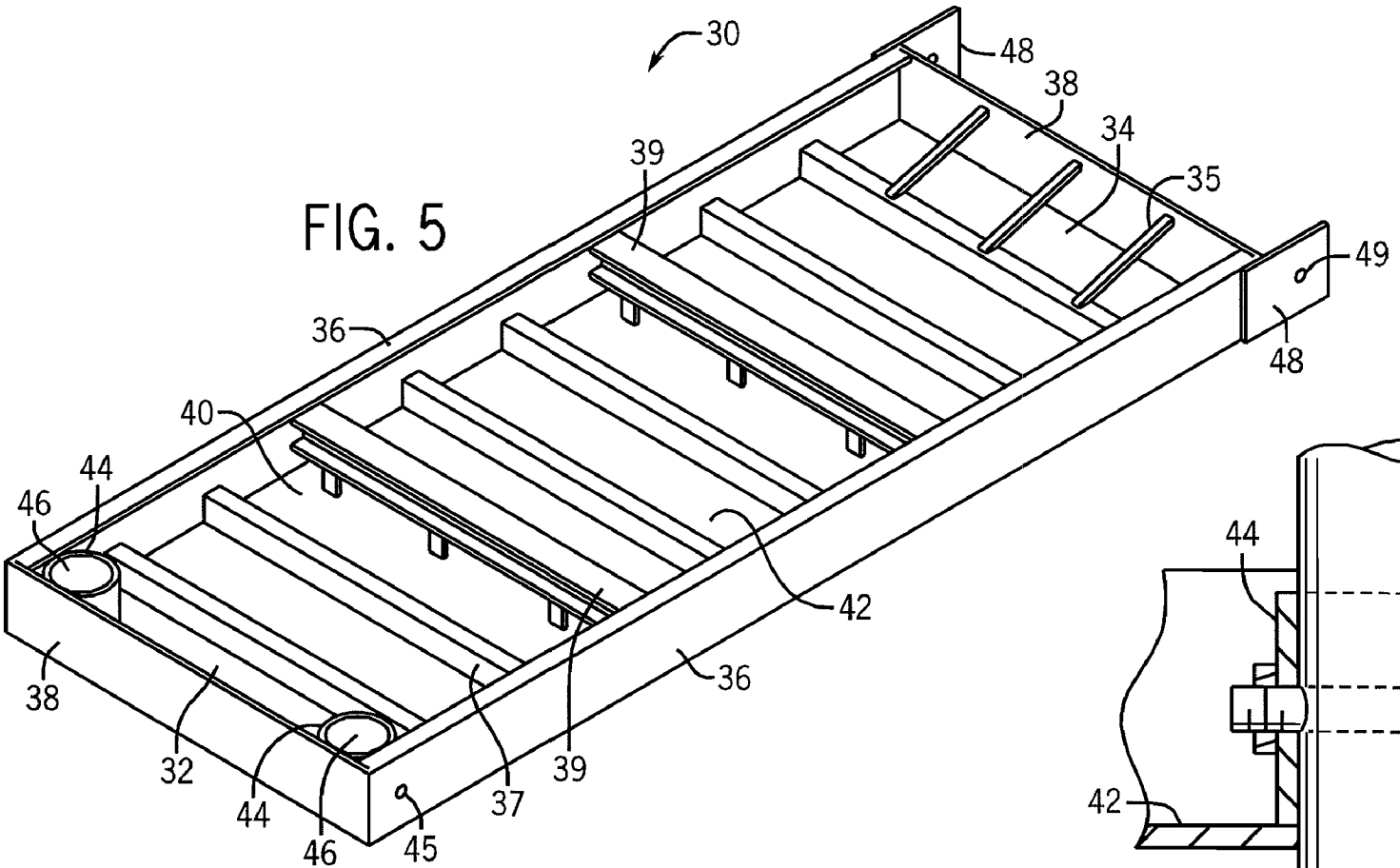
FIG. 5 is a top, front and right side perspective view of the dock element shown in FIGS. 3 and 4.

As previously alluded to, each dock element 30 is a pan-like structure having a first end 32, a second end 34, a pair of opposing side walls 36, a pair of opposing end walls 38 and a floor 42. The side walls 36, 38 and floor 42 form a cavity 40 within the element 30. Extending between the opposing side walls 36 are a plurality of variously configured reinforcement members 35, 37, 39 which may, in turn, be supported by other substructures of the type shown in FIGS. 4 and 5.

Figure 3:
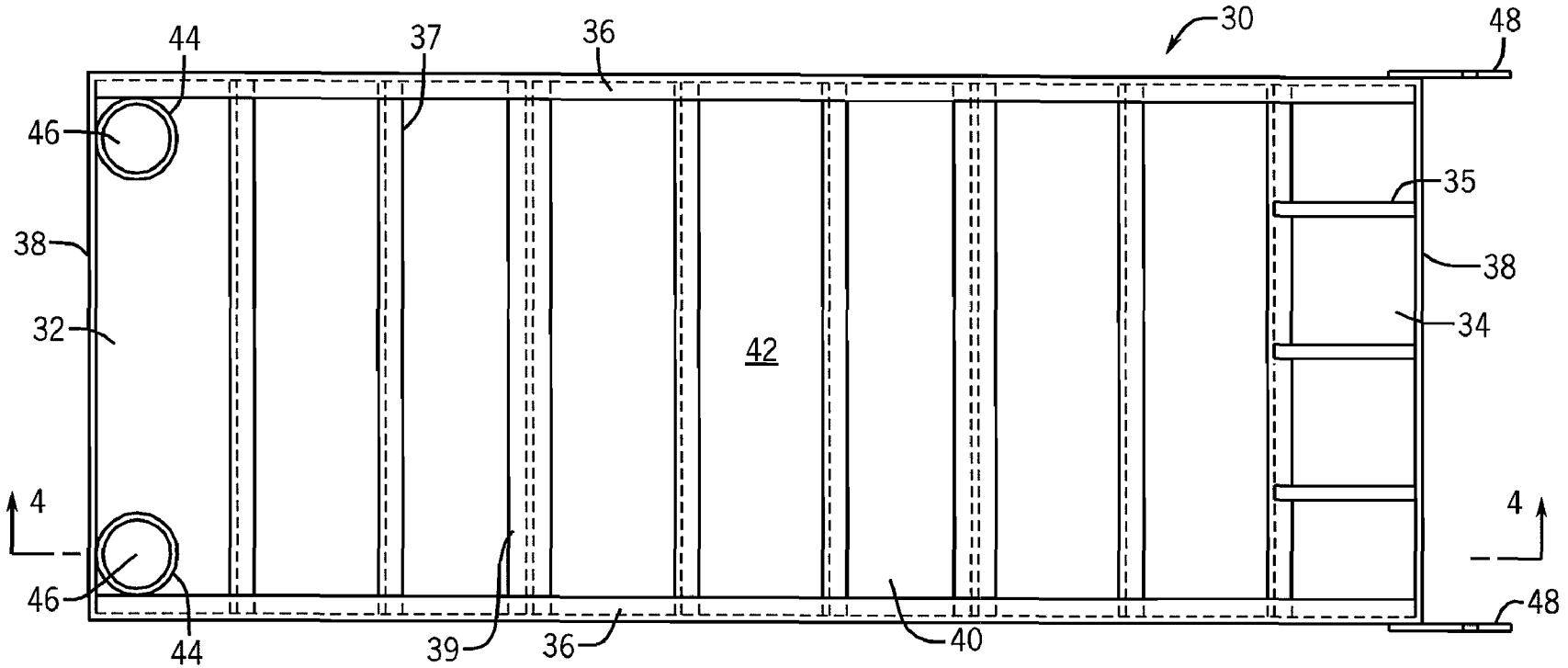
FIG. 3 is a top plan view of one dock element of the dock assembly in accordance with the present invention.
Figure 6:
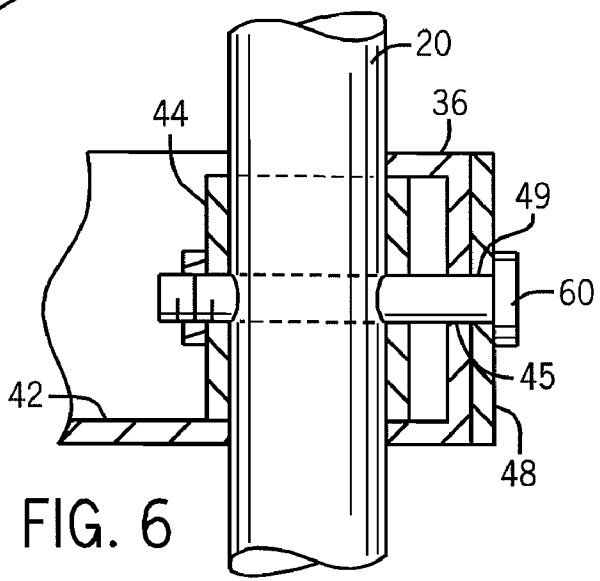
FIG. 6 is an enlarged and partially cross-sectioned view of the dock element as it would be attached to a piling of the type shown in FIG. 2.

At the first end 32 of each dock element 30 is a pair of cylindrical rims 44, each of which forms a vertically-disposed cylindrical opening 46. Each opening 46 is functionally adapted to receive a piling 20 through it. This allows the dock element 30 to be positioned at various heights along the pilings 20. Positioning and fastening of adjacent dock element 30 is also established by a pair of overlapping members 48 that are formed at the second end 34 of the dock element 30, opposite the rims 44 and openings 46. See FIG. 3. Each overlapping member 48 has an aperture 49 formed in it for receiving a fastener 60, of the type shown in FIG. 6. A like aperture 45 is formed into the sidewall 36 and rim 44 to allow dock elements 30 to be secured, one overlapping a portion of the other. That is, the overlapping member 48 of the second end 34 of an element 30 effectively "overlaps" the first end 32 of the next adjacent element 30. With the apertures 45, 49 aligned in collinear fashion, the fastener 60 can be affixed as shown in FIG. 6.

Upon installation of a dock element 30 and securement of it to all adjacent pilings 20, the cavity 40 of the dock element 30 is filled with concrete 50. See FIG. 2. Upon curing of the concrete 50, the rigidity of the dock element 30 is established and the overall strength of the assembly 10 makes it highly resistant to freeze-thaw cycles that may be encountered at the point of installation and use of the assembly 10.

As alluded to previously, the height of each dock element 30 can be adjusted along the length of each piling 20 to accommodate vertical adjustment of the assembly 10, or of its individual dock elements 30, during high-water and low-water conditions. It is to be understood that dock elements 30 can also be positioned transversely within the assembly 10 to form a "T-shaped" or "L-shaped" dock configuration. It is also to be understood that other elements may be added to the assembly 10 such as wood facing attached to the outer surfaces of the side walls 36, wood bumpers and lift systems, all of which are considered alternative embodiments within the scope of the present invention.

I claim:

1. A dock structure for use with vertical pilings, the structure comprising:

a first end and a second end, a pair of opposing side walls, a pair of opposing end walls, one end wall disposed at each end of the structure, and a floor;

wherein the side walls, the end walls and the floor form a cavity;

a pair of cylindrical rims disposed at the first end of the structure, each rim forming a vertically-disposed cylindrical opening in the floor and each opening being functionally adapted to receive a piling through it; and a pair of overlapping members formed at the second end of the structure;

wherein each overlapping member has an aperture formed in it for receiving a fastener; and wherein each cylindrical rim and that portion of the side wall adjacent the rim has an aperture formed in it for receiving a fastener.

2. The dock structure of claim 1 further comprising at least one reinforcement member extending between the opposing side walls.

3. The dock structure of claim 1 wherein the cavity is filled with concrete.

4. A dock assembly for use with a plurality of vertical pilings, the assembly comprising:

at least one dock element, the element comprising a pan-like structure having a first end and a second end, a pair of opposing side walls, a pair of opposing end walls, one end wall disposed at each end of the element, and a floor;

wherein the side walls, the end walls and the floor form a cavity within the element;

a pair of cylindrical rims disposed at the first end of the dock element, each rim forming a vertically-disposed cylindrical opening in the floor of the element and each opening being functionally adapted to receive a piling through it; and a pair of overlapping members formed at the second end of the dock element;

wherein each overlapping member has an aperture formed in it for receiving a fastener; and wherein each cylindrical rim and that portion of the side wall adjacent the rim has an aperture formed in it for receiving a fastener.

5. The dock assembly of claim 4 wherein the apertures of the overlapping members, the cylindrical rims and side walls are collinear.

6. The dock assembly of claim 4 further comprising at least one reinforcement member extending between the opposing side walls of the dock element.

7. The dock assembly of claim 4 wherein the cavity of the pan-like structure of each element is filled with concrete.

8. A method of constructing a dock assembly for use with a plurality of vertical pilings, the method comprising the steps of:

providing at least one dock element, the element comprising a pan-like structure having a first end and a second end, a pair of opposing side walls, a pair of opposing end walls, one end wall disposed at each end of the element, and a floor;

wherein the side walls, the end walls and the floor form a cavity within the element;

providing a pair of cylindrical rims disposed at the first end of the dock element, each rim forming a vertically-disposed cylindrical opening in the floor of the element and each opening being functionally adapted to receive a piling through it;

providing a pair of overlapping members formed at the second end of the dock element;

forming an aperture in each cylindrical rim and that portion of the side wall adjacent the rim for receiving a fastener;

mounting the at least one dock element to a plurality of pilings; and filling the cavity within the at least one dock element with concrete.

9. The method of claim 8 wherein the aperture forming steps further comprise the step of providing apertures that are collinear.

10. The method of claim 9 comprising, after the aperture forming steps, the step of providing a fastener and the step of inserting a fastener through the apertures and into the piling.

11. The method of claim 8 further comprising, prior to the concrete filling step, the step of providing at least one reinforcement member that extends between the opposing side walls of the dock element.

12. The method of claim 8 wherein a plurality of dock elements are positioned to form a continuous dock structure.

* * * * *